US005984453A

United States Patent [19]

Numata

[11] Patent Number: 5,984,453

[45] Date of Patent: Nov. 16, 1999

[54] RECORDING APPARATUS AND METHOD BY TIME-DIVISION DRIVE

[75] Inventor: Yasuhiro Numata, Yokohama, Japan

[73] Assignee: Canon Kabushiki Kaisha, Tokyo, Japan

[21] Appl. No.: 08/352,441

[22] Filed: Dec. 9, 1994

Related U.S. Application Data

[63] Continuation of application No. 07/815,147, Dec. 31, 1991, abandoned.

[30] Foreign Application Priority Data

Jan. 11, 1991 [JP] Japan ..... 3-002248

[51] Int. Cl.[6] ..... B41J 2/145

[52] U.S. Cl. ..... 347/40

[58] Field of Search ..... 347/40, 41, 37, 347/12, 43, 180, 181, 182, 211; 358/296; 400/82, 53

[56] References Cited

U.S. PATENT DOCUMENTS

| | | | |
|---|---|---|---|
| 4,059,183 | 11/1977 | Hoskins | 347/41 X |
| 4,567,570 | 1/1986 | Peer | 400/61 X |
| 4,748,453 | 5/1988 | Lin et al. | 347/41 |
| 4,758,103 | 7/1988 | Angst et al. | 400/689 X |
| 4,864,328 | 9/1989 | Fischbeck | 347/43 |
| 4,972,270 | 11/1990 | Kustin et al. | 358/296 |

*Primary Examiner*—N. Le
*Assistant Examiner*—Michael Nghiem
*Attorney, Agent, or Firm*—Fitzpatrick, Cella, Harper & Scinto

[57] ABSTRACT

In a recording apparatus capable of effecting time-division drive, in a predetermined sequence, the plural blocks formed by dividing plural recording elements of a recording head, if the time-division drive is started from the blocks in the lower half of the recording head as in a reduced image recording operation, the timing of the time-division drive is delayed from the ordinary timing, in order to prevent aberration in the print position in the recorded image.

15 Claims, 10 Drawing Sheets

RECORDING APPARATUS AND METHOD BY TIME-DIVISION DRIVE

This application is a continuation of application Ser. No. 07/815,147 filed Dec. 31, 1991, now abandoned.

BACKGROUND OF THE INVENTION

1. Field of the Invention

The present invention relates to a recording apparatus capable of driving a recording head consisting of plural recording elements by time-division drive.

2. Related Background Art

With the recent commercialization of the information processing equipment such as copying machines, word processors and computers, and other communication equipment, digital image recording apparatus such as those employing a recording system or thermal transfer recording system are rapidly becoming popular for image output for the above-mentioned equipment. Such recording apparatus generally employs a recording head consisting of an array of plural recording elements (hereinafter after called multi-element head) for the purpose of increasing the recording speed. For example, in the ink jet recording, there is generally employed a so-called multi-nozzle head in which a plurality of ink discharge openings 100 and ink channels are integrally formed, and in the thermal or thermal transfer recording head, there are generally integrated plural heater elements.

For such multi-nozzle head, there is usually employed time-division driving method by dividing said head into plural blocks. Since the divided blocks are driven at different timings and the recording head performs scanning motion even between such different timings, there is generated a slight aberration in the position of recording. For compensating such aberration, the recording head is inclined as shown in FIG. 1.

Because of such inclined positioning of the head 30, the positions of the prints are aligned linearly, though the recording operations of the neighboring blocks are different by $t_b$ in time.

It is also possible to activate arbitrary ones among plural blocks of the recording head, as shown in FIGS. 2(A) and 2(B), which illustrate, as an example, the procedure of recording an input image in a size reduced to ½. At first blocks (digits) 9 to 16 (cf. FIG. 4) are blocked, and digits 1 to 8 are activated to record a ½-reduced image with the upper half of the recording head and with the main scanning motion (FIG. 2(A)). Then the digits 1 to 8 are blocked, while the digits 9 to 16 are activated to record a next ½-reduced image with the lower half of the recording head, with the main scanning motion but without the sub scanning motion (FIG. 2(B)).

In this example, each digit consists of 8 pixels or dots, so that the recording head can record 16×8= 128 dots at a time.

A reduced print image shown in FIG. 2(B) can be obtained in this manner. Although satisfactory image quality can be obtained in the unreduced image, the image quality is deteriorated in the reduced image recording since the recording of the second line becomes aberrated from that of the first line, as shown in FIG. 2(*b*). Said aberration in the reduced image recording results from an aberration in the on-timing of the digits, as will be explained in the following with reference to FIGS. 3 and 4.

FIG. 4 shows the on-timing of the digits of the ink jet recording head at unreduced image recording. In every line, the digits are turned on sequentially from digit 1 to 16, in synchronization with basic clock signals. The on-timing of the digits in the reduced image recording is same as that of the unreduced image recording for the upper half (cf. FIG. 2(A)), but is different from that for the lower half (FIG. 2(B)). FIG. 3 shows the on-timing of the digits 9 to 16, wherein (a) and (b) respectively show the timing in reduced image recording and in unreduced image recording. It will be understood that the timing for each digit is different by a time Ta for these two recording modes.

The conventional driving method, as explained in the foregoing, has resulted in an aberration in the obtained print, since the drive timing is not changed according to the change in the sequence of time-division drive.

SUMMARY OF THE INVENTION

An object of the present invention is to provide a recording apparatus capable of high-quality image recording without aberration in the recorded image, even when the sequence of time-division drive is varied.

Another object of the present invention is to provide a recording apparatus which is free from aberration in the recorded image even when a part of the recording head is selectively used for recording.

Still another object of the present invention is to provide a recording apparatus which is free from aberration in the recorded image even when the upper and lower parts of the recording head are selectively used for recording an image reduced in size.

The above-mentioned objects can be attained, according to the present invention, by a recording apparatus for effecting a recording operation by moving a recording head, consisting of plural recording elements, in a scanning motion relative to a recording medium, comprising:

drive means for effecting time-division drive in a predetermined sequence on plural blocks, formed by dividing the plural recording elements of said recording head;

drive sequence varying means for varying the sequence of time-division drive conducted by said drive means; and timing control means for varying the drive timing according to the sequence of time-division drive varied by said drive sequence varying means.

The above-mentioned objects can be furthermore attained, according to the present invention, by a recording apparatus for effecting a recording operation by moving a recording head, consisting of plural recording elements, in a scanning motion relative to a recording medium, comprising:

drive means for driving plural recording elements of said recording head in plural blocks, said drive means having a first mode for driving all the recording elements in succession in plural blocks, and a second mode for driving a selected part of said recording elements in succession in plural blocks; and drive timing control means for varying, in the drive by said drive means in said second mode, the drive timing of blocks in said selected part of the recording elements, according to said selected recording elements.

The above-mentioned objects can be furthermore attained, according to the present invention, by a recording method for effecting a recording operation by moving a recording head in a scanning motion relative to a recording medium, comprising:

a first drive step for driving all the plural recording elements of said recording head in time-division successive manner in plural blocks;

a second drive step for driving a selected part of the plural recording elements of said recording head in time-division successive manner in plural blocks; and a step for varying the drive timing of the blocks according to said selected recording elements, in the course of execution of said second recording step.

The above-mentioned embodiments allow to prevent aberration in the recorded image, since the drive timing is varied according to a change in the time-division drive mode.

DETAILED DESCRIPTION OF THE PREFERRED EMBODIMENTS

Now the present invention will be clarified in detail by embodiments thereof shown in the attached drawings.

Figure 5:
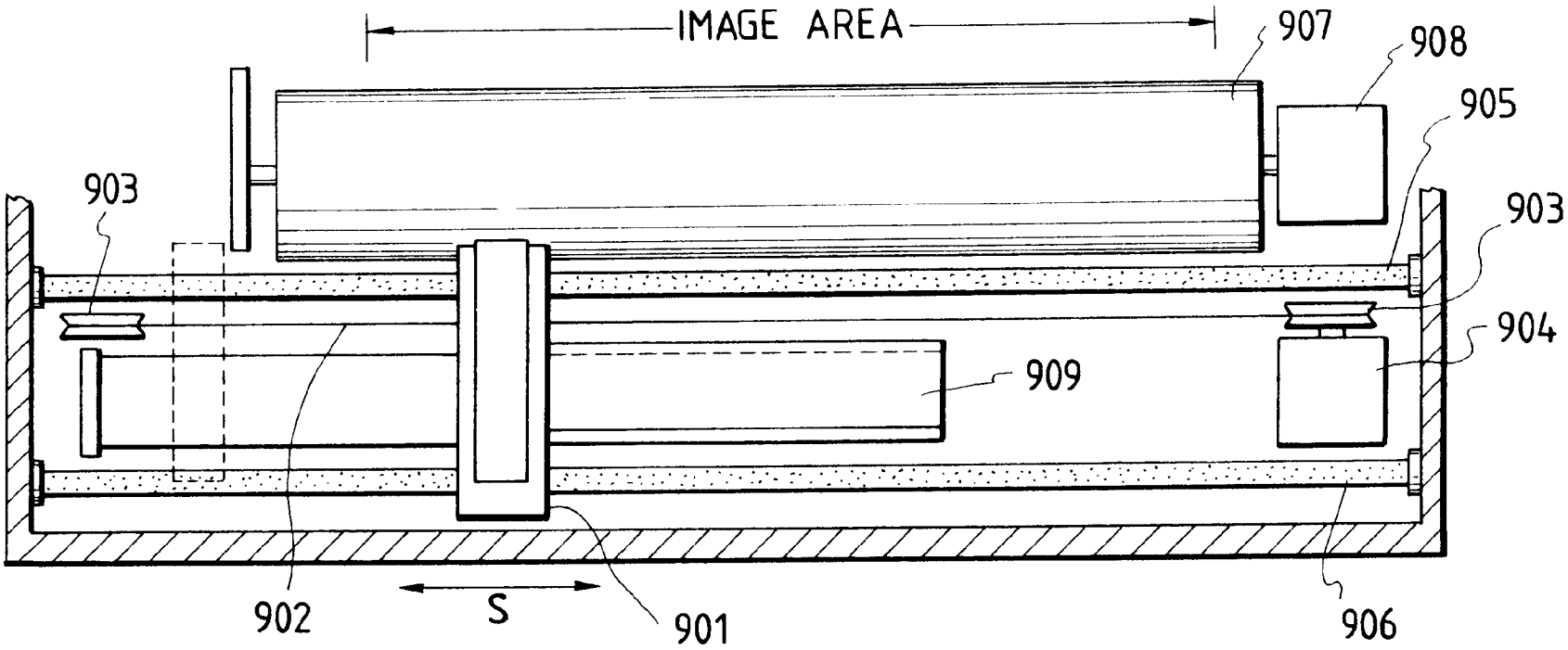
FIG. 5 is a schematic view of an ink jet recording apparatus embodying the present invention.

At first there will be briefly explained an ink jet recording apparatus embodying the present invention, with reference to a schematic view shown in FIG. 5.

In FIG. 5 there are shown a carriage 901 driven in the main scanning direction S; a wire 902 fixed to said carriage 901 and supported between pulleys 903 positioned on both ends of the moving path of said carriage; a motor 904 linked with one of said pulleys, for moving the carriage 901 in scanning motion in the direction S; first and second guide rails 905, 906 extended in said direction S, for guiding said carriage 901; a platen roller 907 for defining the recording face of a recording medium such as paper or film and advancing said recording medium in the sub scanning direction; a motor 908 coupled with said platen roller 907 for rotating the same, in the transportation of the recording medium; a control signal cable 909, fixed at an end to the carriage 901 and at the other end to unrepresented control means for the exchange of image data, control signals etc. between said control means and said carriage, and composed of a flexible cable in order to follow the movement of the carriage 901.

Figure 6:
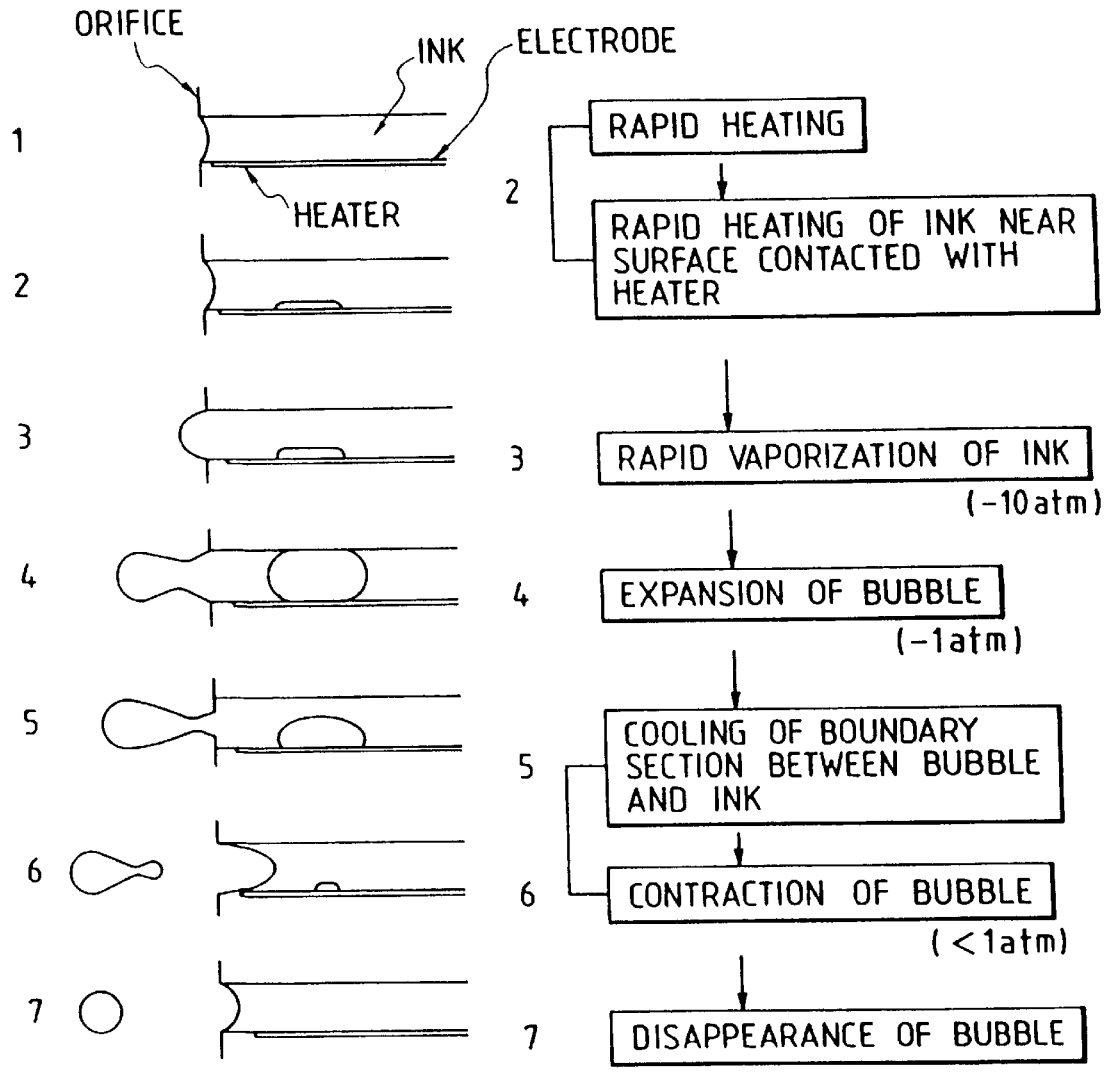
FIG. 6 is a view showing the working principle of an ink jet recording head.

In the following there will be explained the working principle of ink jet recording in the present embodiment, with reference to FIG. 6. In a state (1), ink in a narrow ink channel is exposed to the exterior. On a face of said ink-channel, there is provided a heater, which is heated by current supply at the recording operation. In response to said heating, a bubble is generated in the ink as indicated in states (2) to (7), and the ink is discharged to the exterior by the force of said-bubble.

Figure 1:
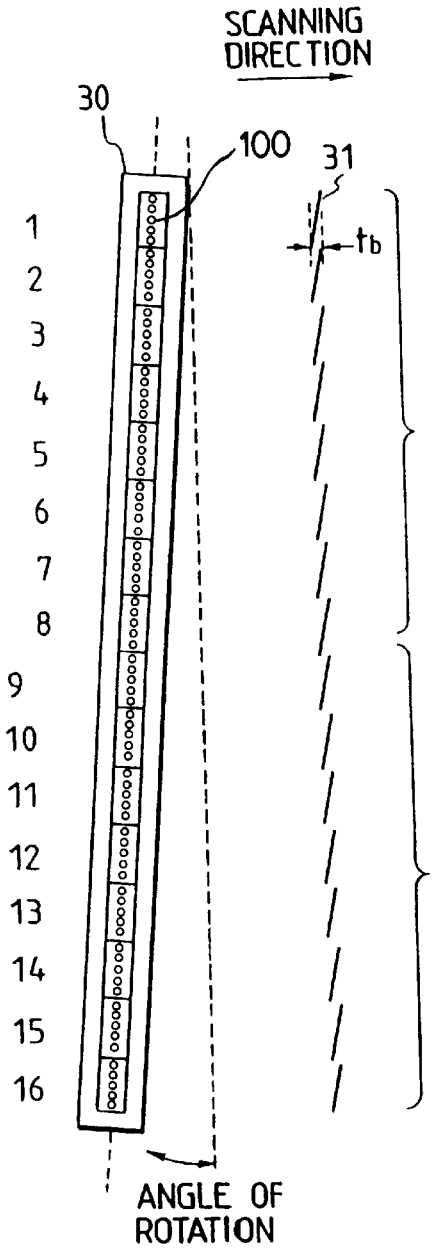
FIG. 1 PRIOR ART
FIG. 1 is a view showing an example of image recorded with an inclined recording head.
Figure 7:
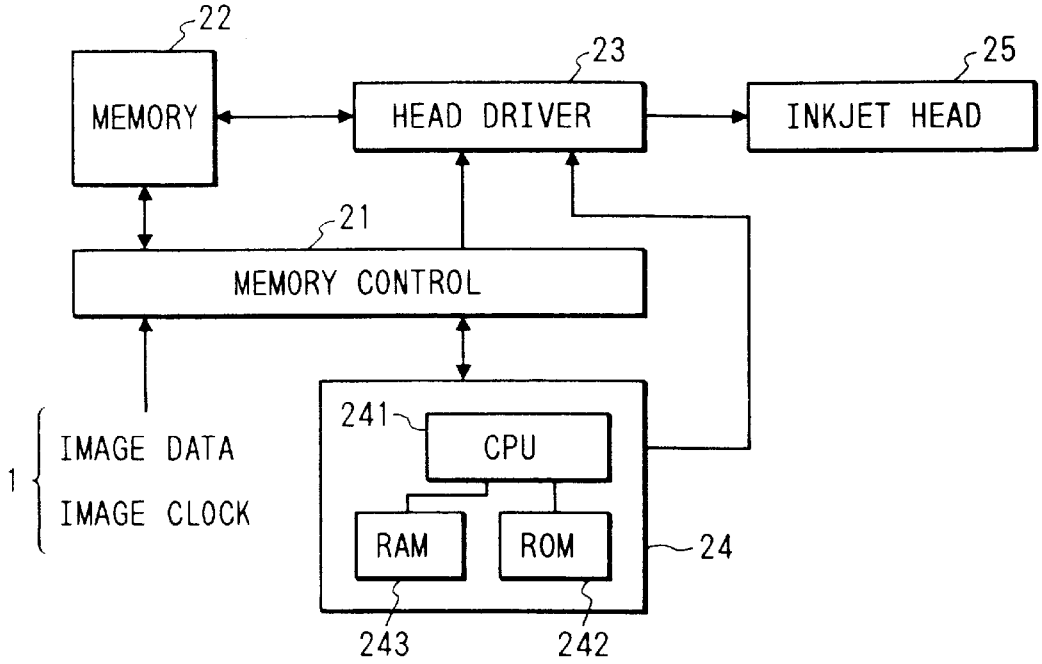
FIG. 7 is a block diagram showing an embodiment of the present invention.

Now reference is made to FIG. 7 for explaining the structure of the present embodiment. Data 1 supplied to the-recording apparatus are stored, by a memory control circuit 21, into a memory 22. The method of recording and reading data into and from the memory is one of the features of the present invention, and will be detailedly explained later. The data stored in the memory 22 are supplied, through a head driver 23, to an ink jet recording head 25 constructed similarly to recording head 30 shown in FIG. 1. The function of said memory 22 is controlled by the memory control circuit 21, which is in turn controlled by the image data 1 and signals from a control unit 24, which includes a CPU 241 for executing process to be explained later, a ROM 242 for storing fixed data, such as a program corresponding to said process, a RAM 243 etc.

Figure 8:
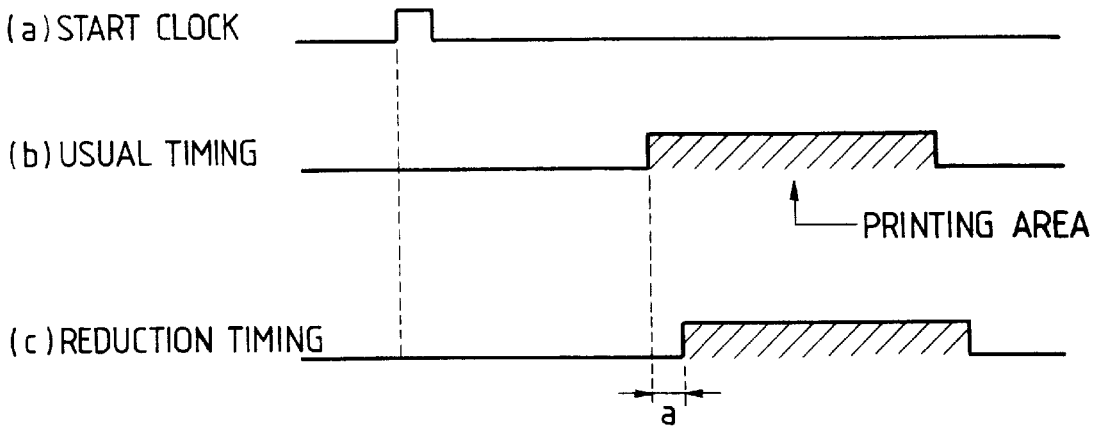
FIG. 8 is a timing chart showing a printing operation in an ink jet recording apparatus.

FIG. 8 shows the timing of recording by the memory control circuit 21. Said timing can be arbitrarily selected according to the value of timing data supplied from the CPU 241. Said memory control circuit 21 is often constructed as a one-chip LSI such as a gate array. It is connected with the CPU 241 through unrepresented read/write signal lines, in addition to the data bus and address bus shown in the drawing. The situation is same for the head driver 7, which additionally contains a power circuit for driving the ink jet recording head, though it will not be explained further.

Figure 9:
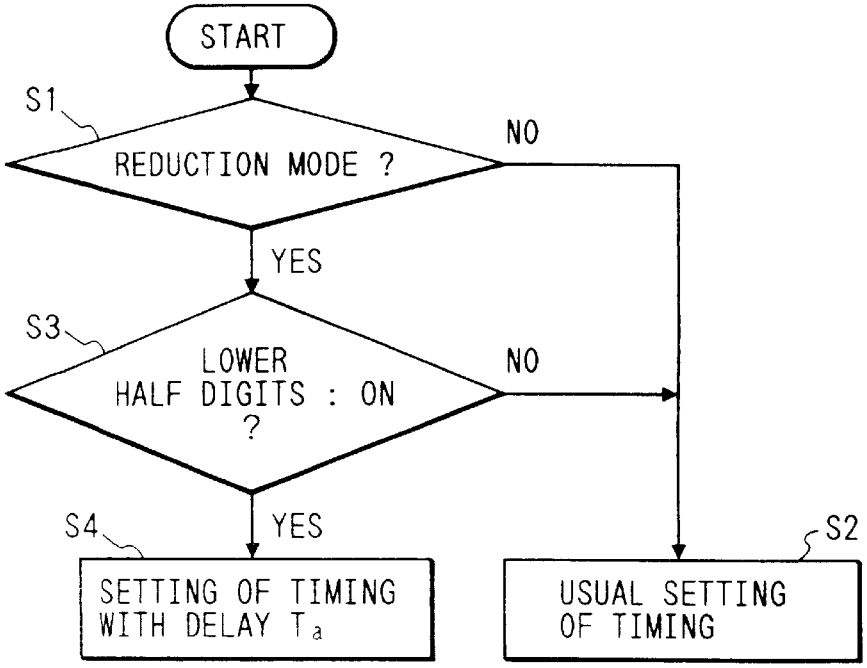
FIG. 9 is a timing chart showing the function of an embodiment of the present invention.

The present embodiment of the above-explained structure functions in the following manner, as represented in a flow chart of head block control shown in FIG. 9. Said control is activated when the ink jet recording apparatus enters a recording operation.

Figure 2A:
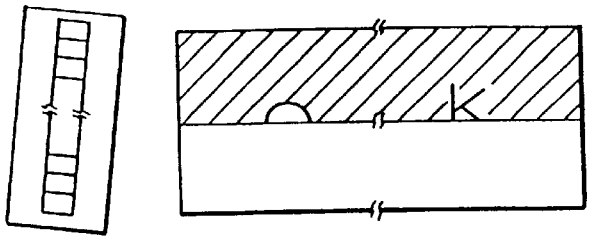
FIG. 2A PRIOR ART
FIGS. 2A and 2B are views showing an example of reduced recording with an ink jet recording apparatus.
Figure 2B:
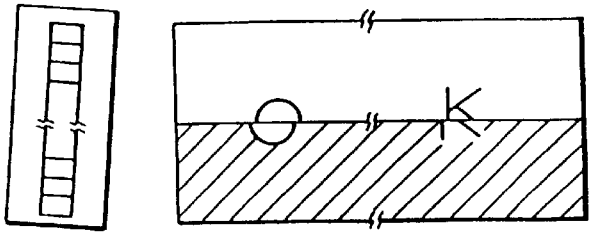
FIG. 2B PRIOR ART
Figure 3:
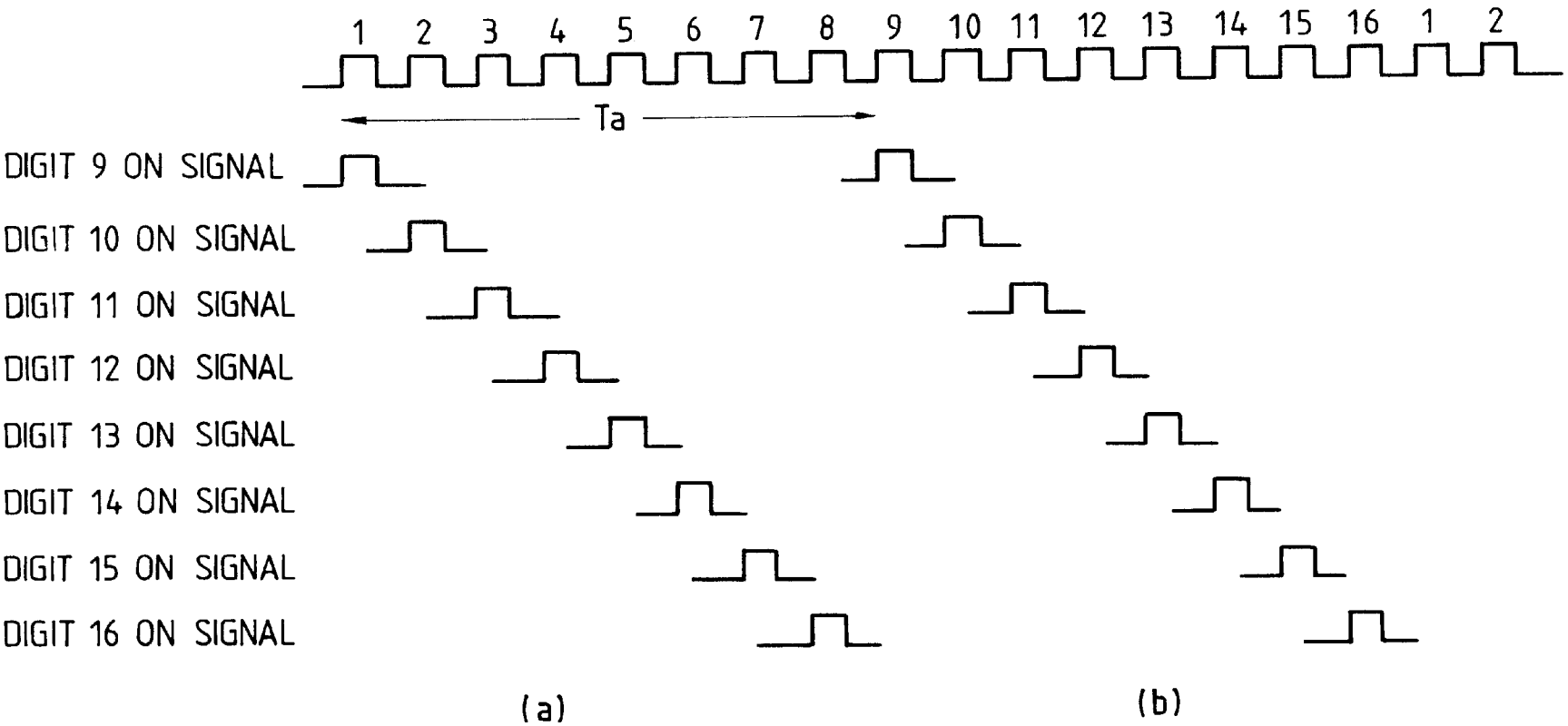
FIG. 3 PRIOR ART
FIG. 3 is a timing chart showing the on-timings of digits in an ink jet recording apparatus, in a reduced image recording.
Figure 4:
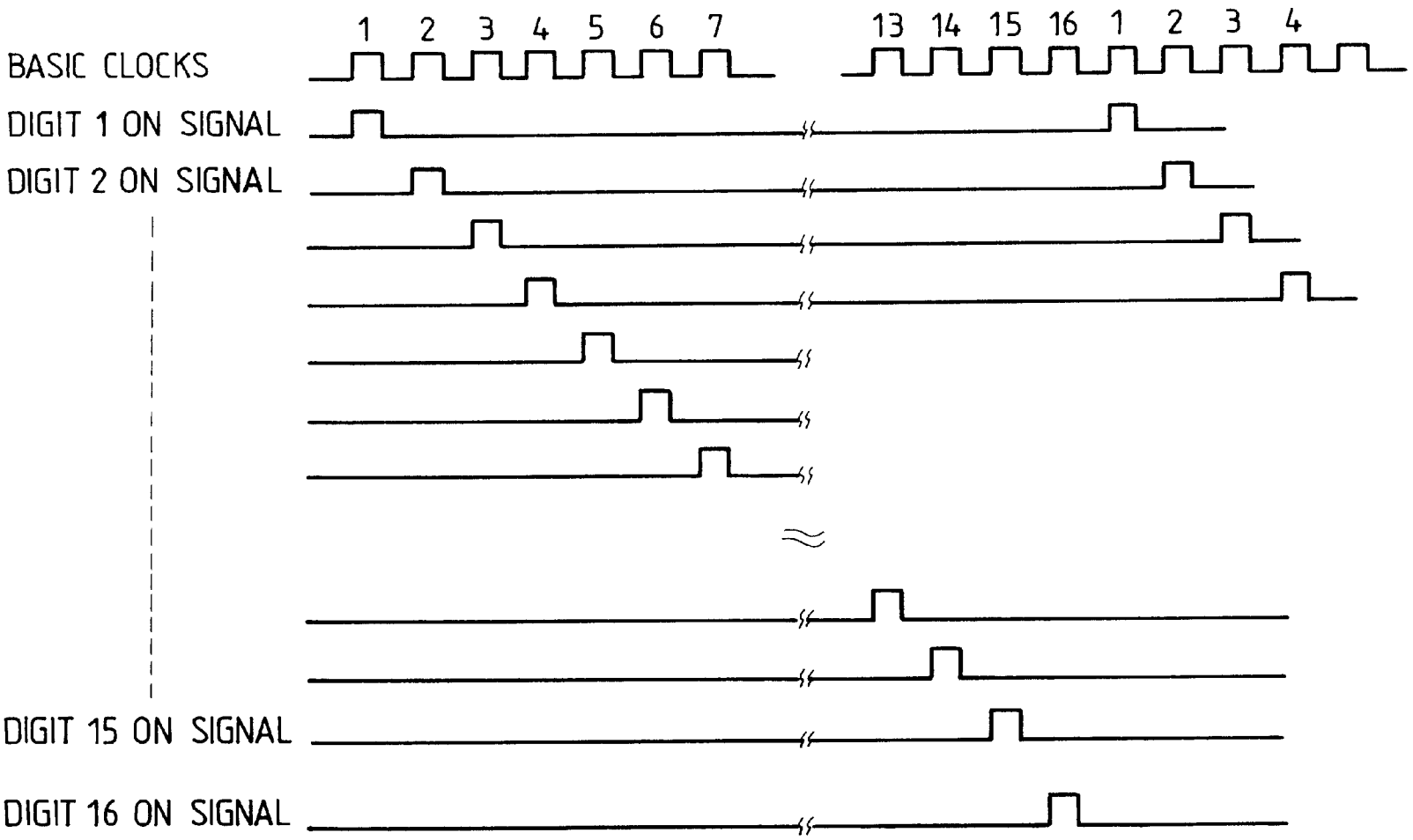
FIG. 4 PRIOR ART
FIG. 4 is a timing chart showing the on-timings of digits in an ink jet recording apparatus, in an unreduced image recording.

In a step S1, the CPU 241 discriminates whether the reduced recording mode is selected. If the unreduced recording mode is selected, a step S2 sets timing data in the memory control circuit 21 so as to attain the ordinary timing shown in FIG. 8(*b*). If the reduced recording mode is selected, a step S3 discriminates whether the upper half or the lower half of the recording head is to be turned on. If the blocks 9–16 in the lower half of the recording head are to be turned on, a step S4 controls the memory control circuit 21 so as to delay the record timing by a time Ta from the ordinary timing of recording (FIG. 8(*c*)). Thus the aberration in the image recorded in the reduced image recording, as shown in FIG. 2A, can be corrected. On the other hand, in case the blocks 1–8 in the upper half of the recording are to be turned on, the step S2 sets the timing data for attaining the ordinary timing of recording.

Figure 10:
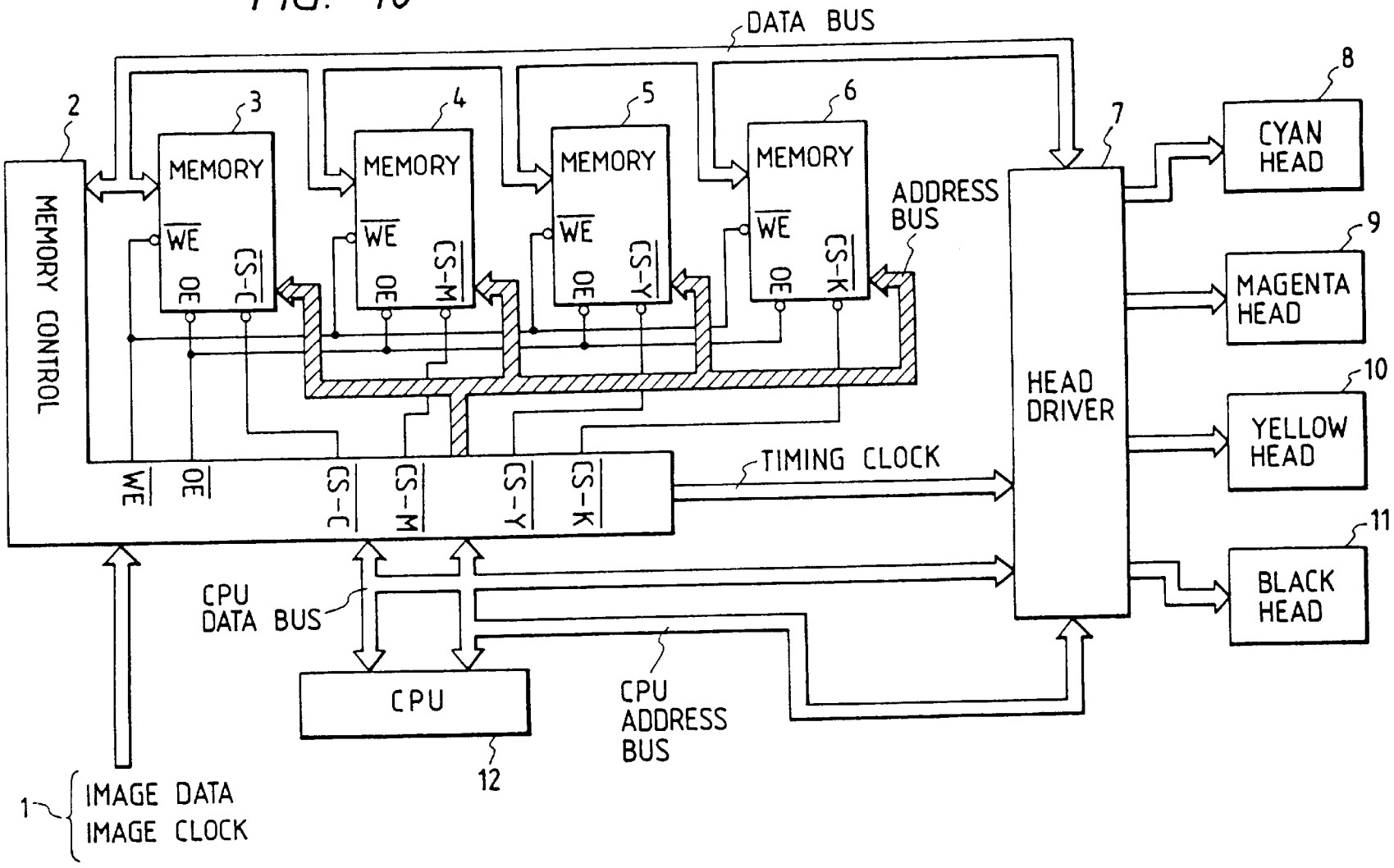
FIG. 10 is a block diagram of a second embodiment of the present invention.

In the following there will be explained a second embodiment of the present invention, which is also effectively applicable to a color printer equipped with plural recording heads, since the control means can be effectively utilized for compensation of the distances between the recording heads. FIG. 10 shows the circuit structure of said control means.

Referring to FIG. 10, data 1 supplied to a memory control circuit 2 are separated into respective colors or into predetermined signals and are stored into corresponding memories 3–6. In case of a color printer, signals of cyan, magenta, yellow and black colors are serially entered and respectively stored in memories 3,.4, 5, 6, from which said data are respectively supplied, through a head driver 7, to a cyan head 8, a magenta head 9, a yellow head 10 and a black head 11.

Said memory control circuit 2 effects compensation for the distances among the recording heads. The record timing control by said control circuit 2 will be explained in the following, with reference to a timing chart shown in FIG. 11. In the ordinary recording, the record timings are controlled by $t_1$–$t_4$, with reference to a start clock (FIG. 11(*a*)), corresponding to the positions of the cyan, magenta, yellow and black heads (FIGS. 11(*b*)–(*e*)).

Figure 11:
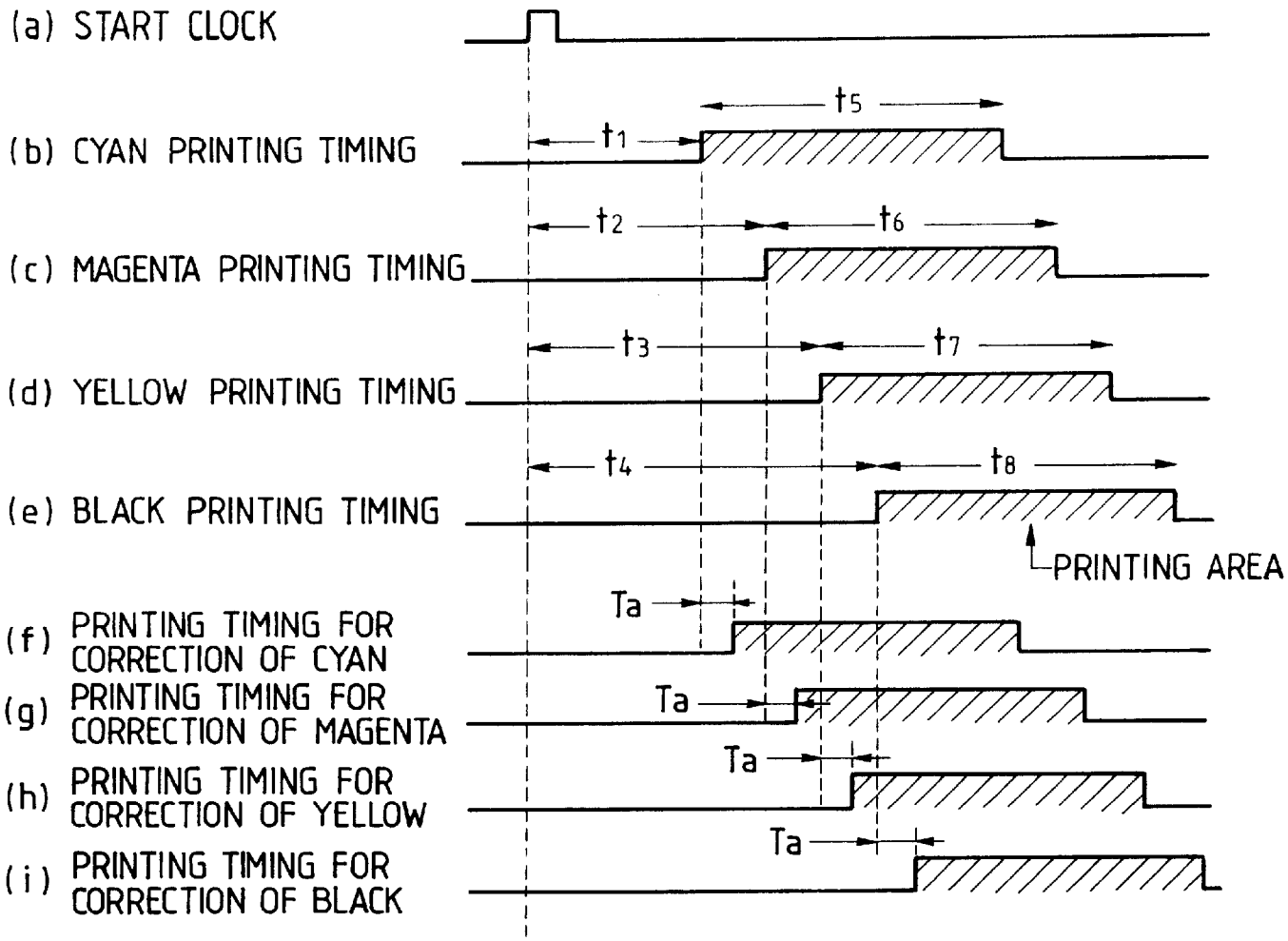

Also in a color ink jet recording apparatus, as in the present embodiment, a delay of the record timing by a time Ta is effective for the reduced image recording. The memory control circuit 2 is capable of controlling the timing of recording, according to the timing data set by a CPU 12. Consequently, in the reduced image recording, the CPU 12 sets the memory control circuit 2 so as to delay the record timing by a time Ta, as indicated in FIGS. 11(*f*)–(*i*).

In the following there will be explained the relationship between the record timing explained above and the data supplied to the head driver 7.

Figure 12:
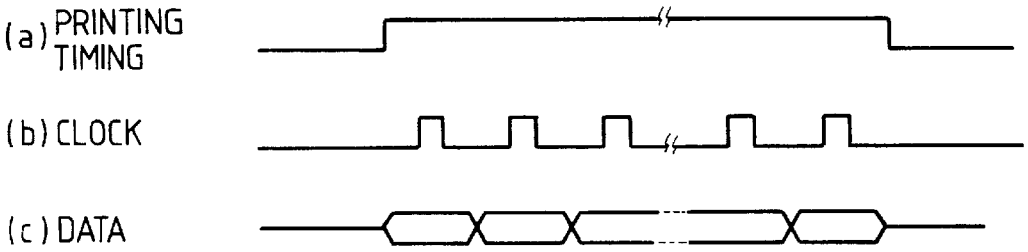
FIGS. 11 and 12 are timing charts showing the recording operation of the second embodiment of the present invention.

Based on a record timing signal (FIG. 12(*a*)) generated by the memory control circuit 2 in response to the timing data set by the CPU 12, an address counter (not shown) in the memory control circuit 2 starts counting, and sends addresses to the memories 3–6. According to said addresses, data are read, as indicated in FIG. 12(*c*), from the memories 3–6 and supplied to the head driver 7. Also together with said record timing signal (a), clock signals (FIG. 12(*b*)) synchronized with said data (c) are supplied to the head driver 7. Based on said clock signals, the head driver 7 fetches said data and drives the recording heads 8–11.

As explained in the foregoing, the drive timing of the recording heads and the data supply thereto can be controlled through the control of record timing.

Figure 13:
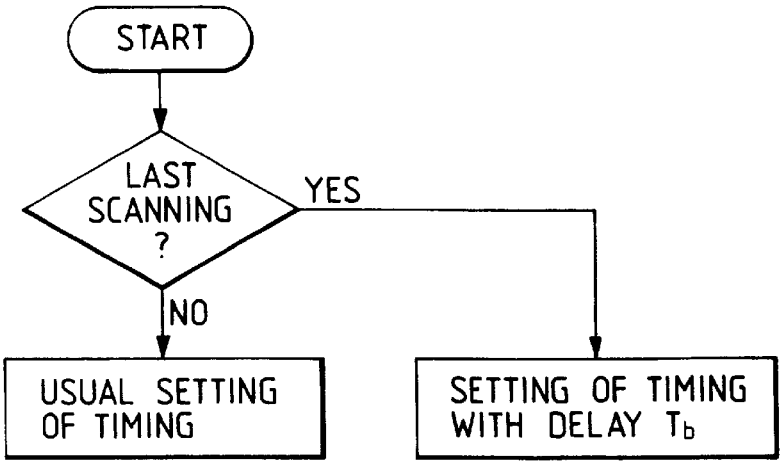
FIG. 13 is a flow chart showing the function of a third embodiment of the present invention.

In the following there will be explained a third embodiment of the present invention. In an ink jet recording apparatus, the recording of the last line on a page is sometimes conducted with masking of a part of the blocks of the recording head, in order to obtain a constant margin at the end of a recording sheet. More specifically, the recording of last line on the A4-sized sheet requires only 6 blocks out of 16 blocks. Said recording is conducted by effecting the sub scanning by a width corresponding to 6 blocks instead of ordinary 16 blocks, while masking the blocks 1–10 and activating 6 blocks from No. 11 to 16. For this reason, even in the unreduced image recording, the timing of recording is delayed by b in the recording of the last line. Also in this case, a satisfactory image can be obtained by a control similar to that in the reduced image recording. The control sequence in this case is shown in FIG. 13.

Figure 14:
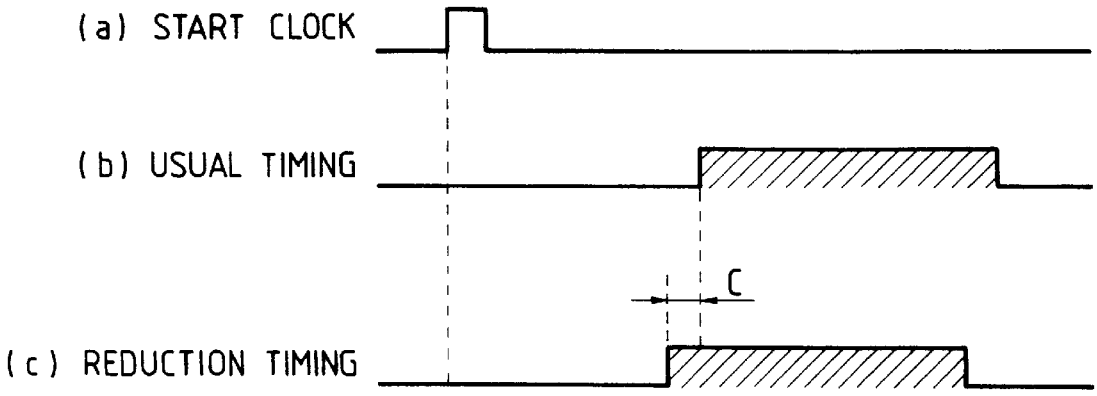
FIG. 14 is a timing chart showing the recording operation of a fourth embodiment of the present invention.

In the following there will be explained a fourth embodiment of the present invention. In the foregoing embodiments, the recording is conducted only in one direction, but the same principle is applicable also to the case of effecting the recording operation also during the returning motion of the recording head. In this case the sequence of on-timings of the blocks is inverted. Consequently the memory control circuit advances the timing by a time c, as shown in FIG. 14.

The present invention is not limited to the ink jet recording apparatus, but is likewise applicable to a thermal recording apparatus or a thermal transfer recording apparatus.

Among various ink jet recording methods, the present invention brings about a particular effect when applied to a recording head of a system utilizing thermal energy for ink discharge, and a recording apparatus employing such recording head.

The principle and representative configuration of said system are disclosed, for example, in U.S. Pat. Nos. 4,723,129 and 4,740,796. This system is applicable to so-called on-demand recording or continuous recording, but is particularly effective in the on-demand recording because, in response to the application of at least a drive signal representing the recording information to an electrothermal converter element positioned corresponding to a liquid channel or a sheet containing liquid (ink) therein, said element generates thermal energy capable of causing a rapid temperature increase exceeding the nucleate boiling point, thereby inducing film boiling on a heat action surface of the recording head and thus forming a bubble in said liquid (ink), in one-to-one correspondence with said drive signal. Said liquid (ink) is discharged through a discharge opening by the growth and contraction of said bubble, thereby forming at least a liquid droplet. Said drive signal is preferably formed as a pulse, as it realizes instantaneous growth and contraction of the bubble, thereby attaining highly responsive discharge of the liquid (ink). Such pulse-shaped drive signal is preferably that disclosed in U.S. Pat. Nos. 4,463,359 and 4,345,262. Also the conditions described in U.S. Pat. No. 4,313,124 relative to the temperature increase rate of said heat action surface allow to obtain further improved recording.

The configuration of the recording head is given by the combinations of the liquid discharge openings, liquid channels and electrothermal converter elements with linear or rectangular liquid channels, disclosed in the above-mentioned patents, but a configuration disclosed in U.S. Pat. No. 4,558,333 in which the heat action part is positioned in a flexed area, and a configuration disclosed in U.S. Pat. No. 4,459,600 also belong to the present invention. Furthermore the present invention is effective in a structure disclosed in the Japanese Patent Laid-open Application No. 59-123670, having a slit common to plural electrothermal converter elements as a discharge opening therefor, or in a structure disclosed in the Japanese Patent Laid-open Application No. 59-138461, having an aperture for absorbing the pressure wave of thermal energy, in correspondence with each discharge opening.

A full-line type recording head, capable of simultaneous recording over the entire width of the recording sheet, may be obtained by plural recording heads so combined as to provide the required length as disclosed in the above-mentioned patents, or may be constructed as a single integrated recording head, and the present invention can more effectively exhibit its advantages in such recording head.

The present invention is furthermore effective in a recording head of interchangeable chip type, which can receive ink supply from the main apparatus and can be electrically connected therewith upon mounting on said main apparatus, or a recording head of cartridge type in which an ink cartridge is integrally constructed with the recording head.

Also the recording apparatus is preferably provided with the emission recovery means and other auxiliary means for the recording head, since the effects of the recording head of the present invention can be stabilized further. Examples of such means for the recording head include capping means, cleaning means, pressurizing or suction means, preliminary heating means composed of electrothermal converter element and/or another heating device, and means for effecting an idle ink discharge independent from the recording operation, all of which are effective for achieving stable recording operation.

Furthermore, the present invention is not limited to a recording mode for recording a single main color such as black, but is extremely effective also to the recording head for recording plural different colors or full color by color mixing, wherein the recording head is either integrally constructed or is composed of plural units.

Furthermore, the ink jet recording apparatus of the present invention is not only usable as an image recording terminal for information processing equipment such as computer, but can also be constructed in combination with an image reader, as a copying apparatus or a facsimile apparatus capable of information transmission and reception.

As explained in the foregoing, the present invention enables to obtain a recorded image of high quality, without aberration in the recording position even when the sequence of time-division drive of the recording head is varied.

I claim:

1. A recording apparatus comprising:

a recording head having plural recording elements arranged in a line oriented at an angle relative to a sub-scan direction and grouped into a set of leading recording elements and a set of following recording elements arranged in block units;

scanning means for reciprocatingly scanning said recording head relative to a recording medium in a forward scan and a backward scan;

drive means for effecting time-division driving on said plural recording elements of said recording head in block units, said drive means having a first mode for sequentially driving all the recording elements in block units, and a second mode for sequentially driving the set of leading recording elements in block units in the forward scan and driving the set of following recording elements in block units in the backward scan; and drive timing control means for adjusting a start timing for driving the set of following recording elements in block units in the second mode so that the set of following recording elements have the same relative drive timing as the set of following recording elements driven in the first mode.

2. A recording apparatus according to claim 1, further comprising sub scanning means for moving the recording head in a sub scanning motion relative to said recording medium.

3. A recording apparatus according to claim 2, wherein said drive means drives, in said second mode, the recording elements of one of a selected upper and lower half of the recording head, in succession in block units.

4. A recording apparatus according to claim 3, wherein said drive timing control means provides a timing same as in said first mode when the recording elements of said upper half are driven, and provides a timing delayed from the timing of said first mode when the recording elements of said lower half are driven.

5. A recording apparatus according to claim 3, wherein said sub scanning means in said second mode, does not effects the sub scanning motion, between the successive drive of blocks of the recording elements in the upper half of said recording head and the successive drive of blocks of the recording elements in the lower half of said recording head.

6. A recording apparatus according to claim 1, wherein said drive means effects drive in said second mode in order to effect a reduced image recording operation during scanning of said recording head by said scanning means as said drive timing control means controls the start timing for a portion of the recording head.

7. A recording apparatus according to claim 1, further comprising sub scanning means for conveying the recording medium in a transporting direction, wherein the plural recording elements of said recording head are arranged in a direction oblique to the transporting direction of the recording medium.

8. A recording apparatus according to claim 1, wherein each of the recording elements of said recording head comprises a discharge opening for ink discharge.

9. A recording apparatus according to claim 8, wherein each of the recording elements of said recording head comprises thermal energy generating means positioned at the discharge opening for effecting a state change in ink by heat, thereby discharging the ink from said discharge opening based on the state change and thus forming a flying ink droplet.

10. A recording apparatus according to claim 1, wherein said recording head comprises plural recording units, with each recording unit of said plural recording units corresponding to ink of a different color, and the recording elements of said recording head effect recording in plural colors.

11. A recording method comprising the steps of:

providing a recording head having plural recording elements arranged in a line oriented at an angle relative to a sub-scan direction and grouped into a set of leading recording elements and a set of following recording elements arranged in block units;

scanning the recording head relative to a recording medium;

effecting time-division drive of all the recording elements of the recording head in block units in a predetermined sequence in a first drive step;

effecting time-division drive of the set of leading recording elements of the recording head in block units in a forward scan, and of the set of following recording elements in a backward scan in a second drive step; and adjusting a start timing of the recording elements to advance a start timing for drive of the set of following recording elements during the backward scan in the second drive step so that the set of following recording elements have the same relative drive timing as the set of following recording elements driven in the first drive step.

12. A recording method according to claim 11, wherein the recording medium is conveyed in a transporting direction and the plural recording elements of the recording head are arranged in a direction oblique to the transporting direction of the recording medium.

13. A recording method according to claim 11, wherein each of the recording elements of the recording head comprises a discharge opening for ink discharge.

14. A recording method according to claim 13, wherein each of the recording elements of the recording head comprises thermal energy generating means positioned at the discharge opening for effecting a state change in ink by heat, thereby discharging the ink from the discharge opening based on the state change and thus forming a flying ink droplet.

15. A recording method according to claim 11, wherein the recording head comprises plural recording units, with each recording unit of the plural recording units corresponding to ink of a different color, and the recording elements of the recording head effect recording in plural colors.

* * * * *

UNITED STATES PATENT AND TRADEMARK OFFICE

CERTIFICATE OF CORRECTION

PATENT NO. : 5,984,453

DATED : November 16, 1999

INVENTOR(S): YASUHIRO NUMATA

It is certified that error appears in the above-identified patent and that said Letters Patent is hereby corrected as shown below:

COLUMN 1

Line 50, "½-reduced" should read --half-reduced--.

COLUMN 3

Line 14, "image" should read --an image--.

COLUMN 4

Line 15, "the-recording" should read --the recording--.

Line 35, "same" should read --the same--.

COLUMN 5

Line 4, "3, 4, 5, 6," should read --3, 4, 5, 6,--.

Line 48, "last" should read --the last--.

UNITED STATES PATENT AND TRADEMARK OFFICE

CERTIFICATE OF CORRECTION

PATENT NO. : 5,984,453

DATED : November 16, 1999

INVENTOR(S) : YASUHIRO NUMATA

It is certified that error appears in the above-identified patent and that said Letters Patent is hereby corrected as shown below:

COLUMN 7

Line 3, "of" should read --of an--.
Line 10, "color by color" should read --color-by-color--.

Signed and Sealed this

Nineteenth Day of September, 2000

*Attest:*

Q. TODD DICKINSON

*Attesting Officer*

*Director of Patents and Trademarks*